United States Patent [19]

Claudy

[11] 4,419,911

[45] Dec. 13, 1983

[54] SOCKET DRIVE WRENCH AND PAWL AND RATCHET ASSEMBLY THEREFOR

[76] Inventor: Steven A. Claudy, 7206 Bentwoods Rd., Hanover, Md. 21076

[21] Appl. No.: 265,230

[22] Filed: May 19, 1981

[51] Int. Cl.[3] ..... B25B 13/46

[52] U.S. Cl. ..... 81/62; 192/43.1

[58] Field of Search ..... 81/60–63.2; 192/43.1

[56] References Cited

U.S. PATENT DOCUMENTS

| | | | |
|---|---|---|---|
| 743,942 | 11/1903 | Sinclair | 81/62 |
| 939,788 | 11/1909 | Bartok | 81/62 |
| 2,003,346 | 6/1935 | Dodge | 81/62 |
| 2,851,914 | 9/1958 | Zeckzer | 81/62 |

FOREIGN PATENT DOCUMENTS

| | | | |
|---|---|---|---|
| 809746 | 10/1951 | Fed. Rep. of Germany | 81/62 |

*Primary Examiner*—James L. Jones, Jr.

*Attorney, Agent, or Firm*—Lerner, David, Littenberg, Krumholz & Mentlik

[57] ABSTRACT

A pawl and ratchet assembly for use in socket drive wrenches or the like which includes a pair of arcuate pawls that encircle a ratchet gear means. A single control is provided for positioning the pawls so that either of the pawls can individually engage the ratchet gear means to provide clockwise and counterclockwise ratcheting, both of the pawls can engage the ratchet gear means to provide a lockup mode and so that both of the pawls can be disengaged from the ratchet gear means to permit a freewheeling mode. In one embodiment, the pawl control means is mounted on the handle of the socket drive wrench to enhance its accessibility in confined areas of use.

25 Claims, 8 Drawing Figures

SOCKET DRIVE WRENCH AND PAWL AND RATCHET ASSEMBLY THEREFOR

BACKGROUND AND/OR ENVIRONMENT OF THE INVENTION

1. Field of the Invention

The present invention relates to tools which are used to impart rotational motion to mechanical elements and more particularly to a socket drive wrench which provides clockwise and counterclockwise ratcheting as well as freewheeling and lockup modes.

2. Description of the Contemporary and/or Prior Art

The need for and application of tools which impart rotational motion to mechanical elements, such as bolts, is well known. Tools which accomplish this function, in the simpliest form, may take the shape of open-ended or box wrenches. When such tools are used, clearance for 360° rotation must be available for the tool or the tool must be constantly disengaged from a bolt or the like that is being rotated and reengaged therewith to function within limited space. In many instances, disengagement and reengagement is quite burdensome because of limited access. In order to overcome this problem, the so called "ratchet wrench" or "socket drive wrench" has evolved.

In its basic form, these ratchet type wrenches permit a portion thereof, usually a "socket" to engage the head of a bolt or the like and permit the socket to ratchet relative to a handle so that a bolt can be loosened or tightened through oscillation of the handle, without disengagement from the bolt. The earliest models of such wrenches only permitted ratcheting in one direction and had to be flipped over or otherwise modified to provide ratcheting in a second direction. Before too long, wrenches which could be switched from clockwise to counterclockwise ratcheting appeared. This is usually accomplished through a dual pawl mechanism such as the types shown in U.S. Pat. Nos. 295,797 issued to Osborn on Mar. 25, 1884; 335,481 issued to Rettberg on Feb. 2, 1886; and 462,995 issued to Poe on Nov. 10, 1891; each of these devices employing single toothed pawls.

Clockwise and counterclockwise rotation in ratchet wrenches or similar tools through the use of a pair of multitoothed pawls, which provide more positive engagement than a single toothed pawl, is shown in U.S. Pat. Nos. 878,657 issued to Munch on Feb. 11, 1908; 1,157,427 issued to Seivert on Nov. 19, 1915; 2,521,419 issued to Sellers on Sept. 5, 1950; 2,660,910 issued to Sellers on Dec. 1, 1953; 2,982,161 issued to Angquist on May 2, 1961; 3,290,969 issued to Bergquist on Dec. 13, 1966; 3,436,992 issued to Over on Apr. 8, 1969; and 3,342,229 issued to Janes on Sept. 19, 1967. Each of these devices employs a control means which is mounted on the head portion of the device and which is used to shift from use of a clockwise to a counterclockwise pawl. The configurations of Angquist and Bergquist, as well as Over, are quite representative of the head type controls widely available on socket wrenches in the marketplace. While quite convenient to use in many applications, several fundamental disadvantages of such configurations exist. If the socket drive wrench is employed to turn a bolt in a tight location, it is quite frequently very difficult to turn the actuator or control which switches the wrench from clockwise to counterclockwise ratcheting without removal of the wrench from the bolt or the like which is being turned. Additionally, the majority of available socket or ratchet wrenches do not permit freewheeling of the drive portion thereof so that the socket mounted thereon can be freely rotated to facilitate initial engagement with the head of a bolt or the like and ancillary rotation of the bolt after the loosening or prior to the tightening thereof. Another disadvantage of these configurations is they do not permit socket drive lockup so that the wrench can be used as a "breaker bar" where no rotation of the socket is permitted relative to the handle portion thereof. As a result, a mechanic must purchase a second tool, commonly known as a breaker bar, to avail himself of this desirable function.

The aforenoted shortcomings of the particular type of socket drive wrenches discussed have been addressed to some degree in the prior art, but are usually solved by complex apparatuses which are fragile, employ numerous components, and/or are expensive to manufacture.

Handle mounted controls for ratchet wrenches and the like are shown in U.S. Pat. Nos. 766,577 issued to Ansorge on Aug. 2, 1904; 846,360 issued to Sprowls on Mar. 5, 1907; 3,608,402 issued to Rainey on Sept. 28, 1971; 2,851,914 issued to Zeckzer on Sept. 16, 1958. Sprowls employs a single pawl which normally engages the ratchet wheel of the wrench thereof and can be retracted by a handle mounted control to permit freewheeling. Ansorge has a pawl which is normally out of engagement with the ratchet wheel thereof and can be forced into engagement by gripping of a handle mounted lever. Rainey employs a coaxially disposed rotatable handle section which reverses the ratchet direction of the tool by alternately engaging multitoothed wedges with the ratchet wheel thereof. By placing the handle control in an intermediate position, a condition is presented where neither wedge engages the ratchet wheel and the device can freewheel. A lockup mode is not provided and engagement between the wedge shaped pawls and the ratchet gear is relatively imprecise and causes great strain on the head portion of the ratchet tool case. Zeckzer, through a handle mounted control, engages alternately a pair of pawls to permit ratchet action in two directions. An intermediate position is provided wherein the ratchet portion of the wrench can freewheel and lockup is provided through use of an independent rod which is urged by a separate control to lock the ratchet when the ratchet is disposed in a certain preselected position. Lockup in a single position only may be quite satisfactory for an open-end ratchet wrench, but is not at all desirable for a socket drive wrench type tool. Additionally, the Zeckzer apparatus is rather complex in that three control rods are required.

Other ratchet wrenches such as those taught in U.S. Pat. Nos. 349,007 issued to Sinclair on Sept. 14, 1886; 743,942 issued to Sinclair on Nov. 10, 1903; 581,427 issued to Olson on Apr. 27, 1897; 1,177,764 issued to Dodge on Apr. 4, 1916; 2,003,346 issued to Dodge on June 4, 1935; and 2,590,387 issued to Dodge on Mar. 25, 1952 also teach handle access controls for ratchet wrenches, some of which selectively permit both of the pawls thereof to engage the ratchet wheels thereof to lock the wrench. Each of these apparatuses uses a pawl configuration wherein the pawls either individually and alternately engage a ratchet wheel or both engage a ratchet wheel at the same time to provide a lockup mode. Olson and Dodge ('387) cannot be locked up since only one of the pawls thereof can engage the ratchet wheels thereof at one time. In Dodge ('764) and Sinclair ('007, '942) both pawls can be permitted to engage the ratchet wheel thereof at the same time to lock up the ratchet wrench. The two Dodge patents ('764, '346) both teach stem type controls longitudinally disposed in the handle of the wrench to effect pawl movement. Nonetheless, both of these wrenches use relatively delicate single toothed pawl arrangements and no use of a multitoothed pawl is shown or suggested. Additionally, freewheeling through disengagement of both pawls is not provided.

The four desirable functions, clockwise and counterclockwise ratcheting, freewheeling and lockup are provided in U.S. Pat. Nos. 1,236,802 issued to Willer on Aug. 14, 1917; and 3,867,855 issued to Siebert on Feb. 25, 1975. However, these functions are achieved in a very dissimilar manner in comparison to the apparatus of the present invention. Willer teaches a wrench which has independently sliding pawls that can be individually engaged or disengaged irrespective of the condition of the other pawl and therefore two controls must be manipulated to achieve the desired function. Siebert teaches a lever actuated ratchet wrench which employs a sliding pawl assembly that can be selectively engaged or disengaged with the ratchet gear thereof. Through manipulation of this lever in combination with a ratchet direction control, locking and freewheeling functions can be employed. However, this device employs relatively fragile single toothed pawls and has an excessive number of mechanical parts which speak against long lasting durability and reasonable manufacturing costs.

The present invention overcomes the problems associated with the prior art by providing a socket drive wrench which provides clockwise and counterclockwise ratcheting functions as well as lockup and freewheeling modes all selectable through a simple handle mounted control that actuates a pair of multitoothed pivoted pawls which are disposed about a ratchet gear which positively and effectively engages the same.

SUMMARY OF THE INVENTION

Therefore, a primary object of the present invention is to provide a pawl and ratchet mechanism incorporated in a socket drive wrench which provides clockwise and counterclockwise ratcheting, lockup, and freewheeling.

Another object of the present invention is to provide a socket drive wrench which can be shifted among clockwise and counterclockwise ratcheting, lockup, and freewheeling by manipulation of a single control.

A further object of the present invention is to provide a socket drive wrench which can be used with conventionally standard sockets.

A still further object of the present invention is to provide a socket drive wrench which employs a multitoothed pawl for positive engagement of the ratchet gear thereof and therefore for strip resistance.

Still another object of the present invention is to provide a socket drive wrench which can be used in place of a breaker bar.

Still another further object of the present invention is to provide a socket drive wrench which has relatively few moving parts.

Another further object of the present invention is to provide a socket drive wrench which employs a handle mounted control for selecting the functions thereof.

Still another object of the present invention is to provide a socket drive wrench which is suitable for use with a socket ejector mechanism.

Another still further object of the present invention is to provide a socket drive wrench wherein all the functions thereof are provided through manipulation of a single handle mounted control.

An additional object of the present invention is to provide a socket drive wrench which is simple in design, relatively inexpensive to manufacture, rugged in construction, easy to use, and efficient in operation.

These objects, as well as further objects and advantages of the present invention, will become readily apparent when reading the ensuing description of two nonlimiting illustrative embodiments and the accompanying drawings.

A socket drive wrench for driving sockets, according to the principles of the present invention, comprises a housing having a drive portion and a handle portion extending therefrom; socket mounting means rotatably carried on the drive portion of the housing, the socket mounting means adapted to accept and removably mount thereon the sockets; ratchet gear means connected to the socket mounting means and rotatable therewith; a pair of pawls pivotally disposed on the drive portion of the housing about and for selectively engaging the ratchet wheel means, the pawls being positionable to permit clockwise and counterclockwise ratcheting, freewheeling, and lockup of the ratchet gear means; and pawl control means for positioning the pawls, the pawl control means contacting and positioning one of the pawls to permit clockwise rotation of the ratchet gear means and the other of the pawls to permit the counterclockwise rotation thereof, the pawl control means engaging and positioning both of the pawls to permit freewheeling of the ratchet gear means, the pawl control means permitting the positioning of both of the pawls to effect lockup of the ratchet gear means.

BRIEF DESCRIPTION OF THE DRAWING

In order that the present invention may be more fully understood, it will now be described, by way of example, with reference to the accompanying drawings in which.

DESCRIPTION OF THE PREFERRED EMBODIMENTS

Figure 1:
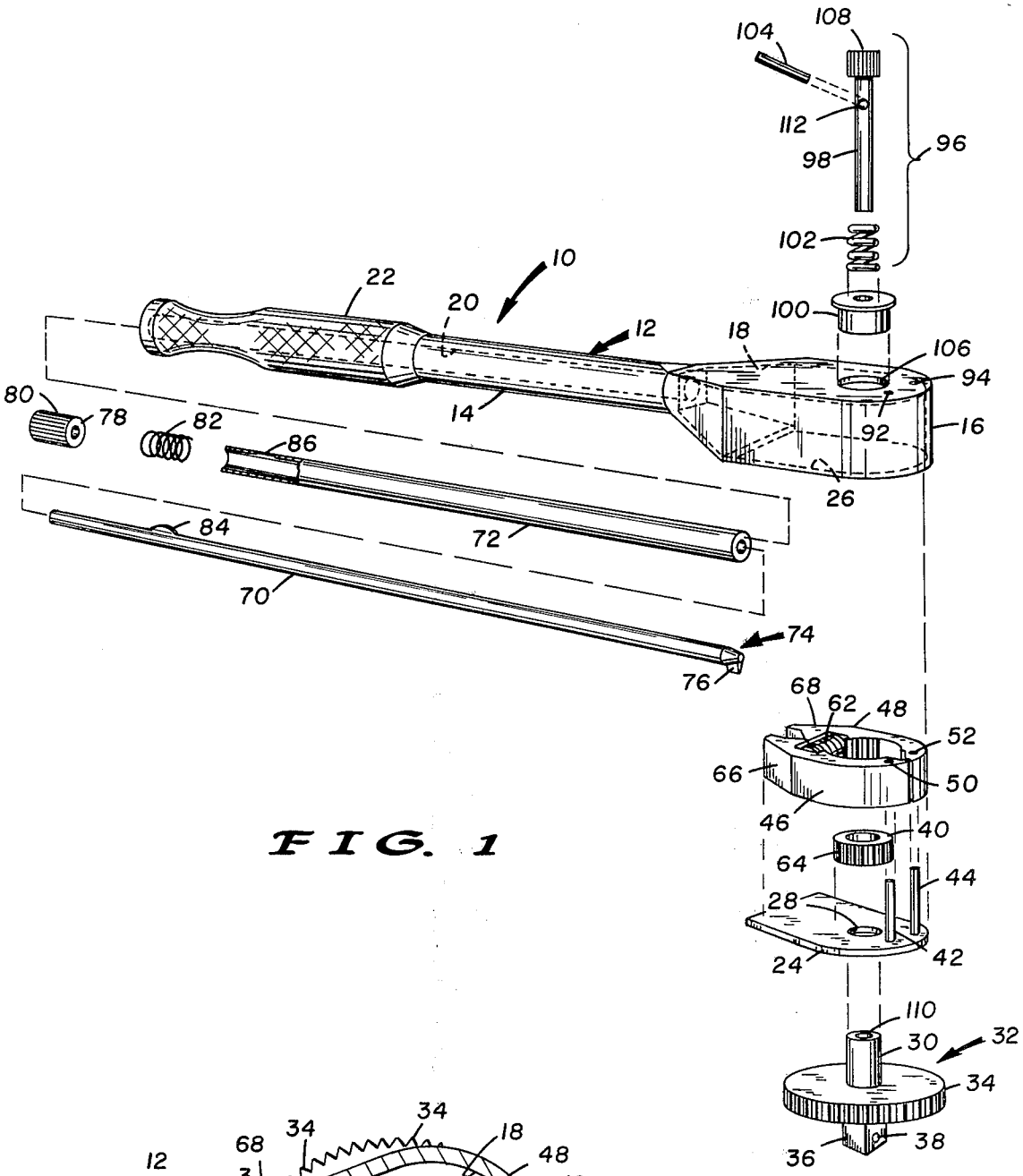
FIG. 1 is an exploded view in perspective of a socket drive wrench incorporating the principles of the present invention therein.
Figure 2:
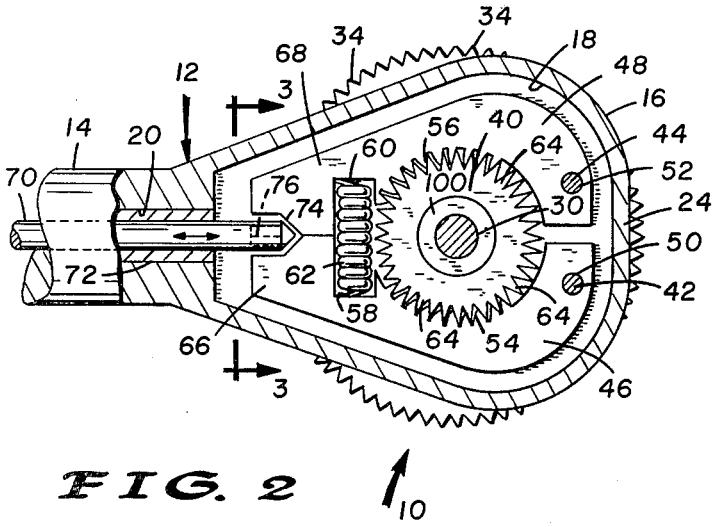
FIG. 2 is an enlarged fragmentary partially broken away top view of the drive portion part of the handle portion of the present invention.

Referring now to the figures, and more particularly to FIGS. 1 and 2 thereof, there is illustrated therein a socket drive wrench 10 which incorporates the principles of the present invention therein. The drive wrench 10 includes a housing 12 having a handle portion 14 and a drive portion 16 forming a chamber 18 therein. The chamber 18 is in communication with a longitudinally disposed chamber 20 located in the handle portion 14 of the housing 12. The handle portion 14 is tapered to provide a suitable grip 22 that preferably incorporates a friction inducing surface as illustrated.

The chamber 18 within the drive portion 16 of the housing 12 is accessible through removal of a plate 24 sized to fit in an opening 26 disposed in the drive portion 16. The plate 24 can be mounted in the opening 26 in any suitable manner when the socket drive wrench 10 is assembled. A particular manner of securing the plate 24 to the opening 26 will be hereinafter described although other suitable or additional methods can be employed. The plate 24 has an aperture 28 disposed therethrough for accommodating the shank 30 of a socket mounting fixture 32. The socket mounting fixture 32 provides a thumbwheel 34 and a socket mounting block 36. The socket mounting block 36 includes a friction inducing member 38 which reciprocates within a bore provided in the socket mounting block 36 as is well known in the art. The socket mounting block 36 is dimensioned so that it can accept a conventional size socket which is usually provided in quarter inch, three-eighth inch, or half inch drive sizes. The thumbwheel 34, which includes a serrated edge for gripping by the user, is provided so that the user can rotate the socket mounting block 36 without moving the handle portion 14 of the housing 12. After the shank 30 of the socket mounting fixture 32 is passed through the aperture 28 disposed in the plate 24, a ratchet gear 40 is fixedly secured thereon. Of course, alternately, the ratchet gear 40 can be integral with the shank 30 and the thumbwheel portion 34 and socket mounting block 36 can be fixedly secured thereto. Such modifications of manufacture are considered well within the skill of those having ordinary skill in the art.

A pair of pivots 42 and 44 are fixedly secured on one end thereof to the plate 28 and extend therefrom in a position substantially normal thereto. The pivots 42 and 44 serve to mount, respectively, pawls 46 and 48, by way of an aperture 50 disposed in pawl 46 and an aperture 52 disposed in pawl 48, pivot 42 extending through aperture 50 and pivot 44 extending through aperture 52 when assembled together. The pawls 46 and 48 are complementary in that the teeth, 54 and 56, provided respectively, in pawl 46 and 48 permit clockwise and counterclockwise ratcheting. The pawls 46 and 48 include an arcuate portion where the teeth 54 and 56 are disposed and are dimensioned so that they can be disposed about and therefore encircle or surround the ratchet gear 40 when the pawls 46 and 48 are disposed thereabout.

Notches 58 and 60 are disposed, respectively, in the pawls 46 and 48 and accommodate therein a helical tension spring 62 fixedly secured on one end thereof to the pawl 46 and on the other end thereof to pawl 48, the spring 62 causing the teeth 54 and 56 of the pawls 46 and 48 to engage the teeth 64 of the ratchet gear 40 when the pawls 46 and 48 are mounted on the pivots 42 and 44. When both pawls 46 and 48 have the teeth 54 and 56, respectively, thereof engaging the teeth 64 of the ratchet gear 40, as illustrated in FIG. 2, the ratchet gear 40 and therefore the shank 30 of the socket mounting fixture 32 cannot rotate. Movement of the end portions 66 and 68 of the pawls 46 and 48, respectively, provide for disengagement of the pawls 46 and 48 from the ratchet gear 40 through pivoting to permit ratcheting.

The teeth 54 of the pawl 46 each include a flat side and a rounded side, as illustrated, so that the pawl 46 locks to the ratchet gear 40 in a counterclockwise direction and is permitted to ratchet in a clockwise direction. Similarly, the teeth 56 of the pawl 48 each include a flat surface and a rounded surface, the teeth 56 locking with the teeth 64 of the ratchet gear 40 in a clockwise direction and ratcheting in a counterclockwise direction.

Movement of the end portions 66 and 68 of the pawls 46 and 48 is effected through manipulation of a control arm or stem 70. A bushing 72 is disposed within the longitudinal chamber 20 of the handle portion 14 of the housing 12 and accommodates therein the control stem 70. As a result, the control stem 70 can rotate as well as reciprocate therein. One end 74 of the control stem 70 is tapered and provides a radially disposed fin 76. The other end 78 of the control stem 70 has a knob 80 fixedly secured thereto. Interposed and trapped between the knob 80 and the bushing 72 and disposed about the stem 70 is a helical compression spring 82. The compression spring 82 forces the knob 80 away from the bushing 72. Since the bushing 72 is fixedly secured to the handle portion 14, this has the effect of pulling the control stem 70 away from the drive portion 16 of the housing 12. Although the spring 82 is employed to produce this pulling effect, other suitable biasing means similarly disposed or otherwise placed may be employed.

A protrusion 84 is provided on the stem 70 and is dimensioned to be captured and removably retained in an annular depression 86 disposed in the bushing 72. When the control stem 70 is pushed toward the drive portion 16 of the housing 12, the protrusion 84 is engaged by the annular depression 86 effectively locking the control stem 70 in this position. Of course, other suitable means instead of protrusion 84 and depression 86 can be employed to provide this locking function.

Figure 3:
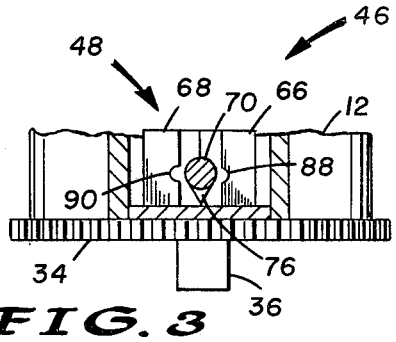
FIG. 3 is a fragmentary cross sectional view taken from lines 3—3 of FIG. 2.

When the control stem 70 is rotated, the fin 76 engages either the end portion 66 of the pawl 46 or the end portion 68 of the pawl 48. With reference to FIG. 3, it can be seen that a groove 88 is provided in the end portion 66 of the pawl 46 and a groove 90 is provided in the end portion 68 of the pawl 48. The grooves 88 and 90 are provided to capture and releasably retain therein the fin 76 to lock the control stem 70 in the position into which it is rotated. Alternately, other suitable means such as engaging protrusions and depressions or ball bearing protrusions which engage depressions or the like can be employed within the spirit and scope of the invention. The free ends of the pivots 42 and 44, as illustrated in FIG. 1, are adapted to be captured and retained within apertures 92 and 94 disposed in the drive portion 16 of the housing 12. When the ends of the pivots 42 and 44 are disposed, respectively, in the apertures 92 and 94, the plate 24 is positioned within the opening 26 to close the housing. Other suitable means such as spring retaining clips, welds, screws, or the like can be further employed to secure the plate 24 in position.

The housing 12 is preferably constructed of hardened plated steel or the like as is the control stem 70 and the pawls 46 and 48. The ratchet gear 40 is also constructed of a similar suitable material as are most of the rest of the components of the invention. The bushing 72 is preferably made of a smooth metal tube with depression 86 being formed of a semi-resilient inset or the entire tube can be constructed of a material softer than steel such as Nylon or the like. Selection of such materials is well known in the art.

In order to facilitate the disengagement of a socket from the socket mounting block 36, an ejection assembly 96 is provided. Ejection assembly 96 includes a reciprocating pin 98, a collar bushing 100, a spring 102, and a locking pin 104. The collar bushing 100 is dimensioned to be disposed within an aperture 106 located in drive portion 16 of the housing 12. The pin 98 has a head portion 108 at one end thereof, the other end thereof being inserted through the spring 102, the collar bushing 100 and down through a central aperture 110 disposed through the shank 30 of the socket mounting fixture 32. After the pin 98 is inserted through the collar bushing 100, is it retained in place by a locking pin 104 inserted into an aperture 112 disposed through the pin 98 thereby sandwiching the spring 100 between the head 108 and the collar bushing 100. As a result, the pin 98 is urged into a position where it is retracted within the socket mounting block 36. When the head 108 is pushed, the pin 98 extends out through the bottom of the socket mounting block 36 so it can engage a socket mounted thereon and push the same thereoff. Biasing means located or configured differently than the spring 102 can be employed and the assembly 96 can be entirely deleted if desired without detracting from the operability of the invention.

Figure 4:
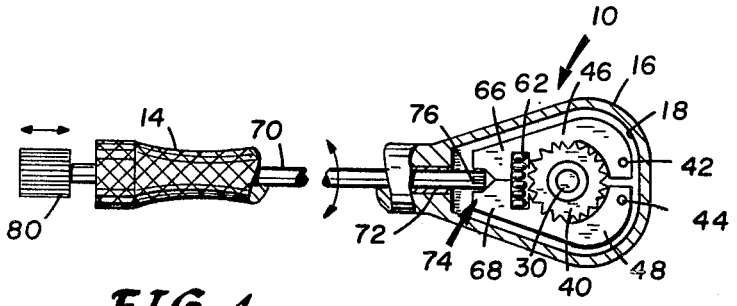
FIG. 4 is a fragmentary partially broken away bottom view of the present invention in a lockup mode.
Figure 5:
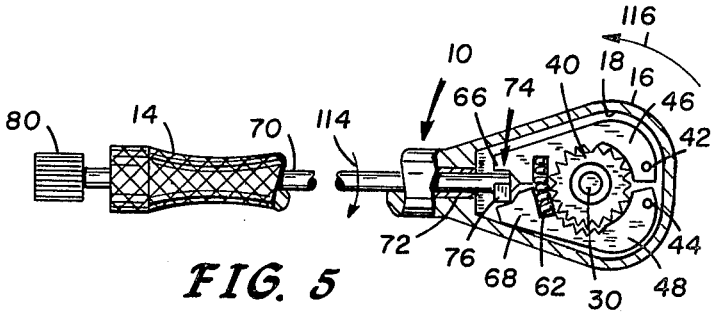
FIG. 5 is a fragmentary partially broken away bottom view of the present invention in a counterclockwise ratchet mode.

FIGS. 4, 5, 6, and 7 illustrate how the control stem 70 is employed to provide lockup, clockwise ratcheting, counterclockwise ratcheting, and freewheeling of the ratchet gear 40 and therefore the socket mounting block 36 and a socket which can be mounted thereon. With reference to FIG. 4, the wrench 10 is shown in a locked up condition wherein both pawls 46 and 48 engage the ratchet gear 40 thereby precluding the rotation thereof. The control stem 70 is in a rest position as urged by the spring 82 discussed in conjunction with and illustrated in FIG. 1. When the control stem 70 is rotated as illustrated by the arrow 114 of FIG. 5, the pawl 48 disengages from the ratchet gear 40 with the fin 76 locking in the groove 90 as discussed in conjunction with FIG. 3. As a result, the handle portion 14 of the housing 12 can be ratcheted in a counterclockwise direction as illustrated by arrow 116 of FIG. 5. Additionally, when the wrench 10 is configured as illustrated in FIG. 5, the wrench 10 is positively engaged in a clockwise direction to the socket mounting block 36 by locking of the pawl 46 to the ratchet gear 40.

Figure 6:
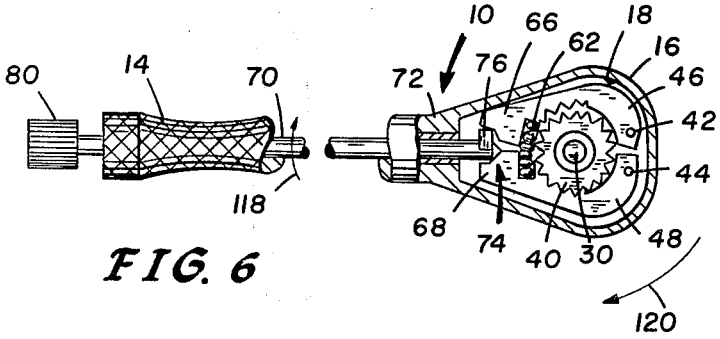
FIG. 6 is a fragmentary partially broken away bottom view of the present invention in a clockwise ratchet mode.

In FIG. 6, the control stem 70 has been rotated in the direction illustrated by arrow 118 so that the fin 76 engages the groove 88 disposed in the pawl 46, as illustrated in FIG. 3. As a result, pawl 46 is disengaged from the ratchet gear 40 and ratcheting of the handle portion 14 in a clockwise direction as illustrated by arrow 120, can be accomplished. Of course, since ratcheting is permitted in a clockwise direction when the wrench 10 is in the condition illustrated in FIG. 6, the wrench 10 is positively engaged in the counterclockwise direction with pawl 48 being locked to ratchet gear 40.

Figure 7:
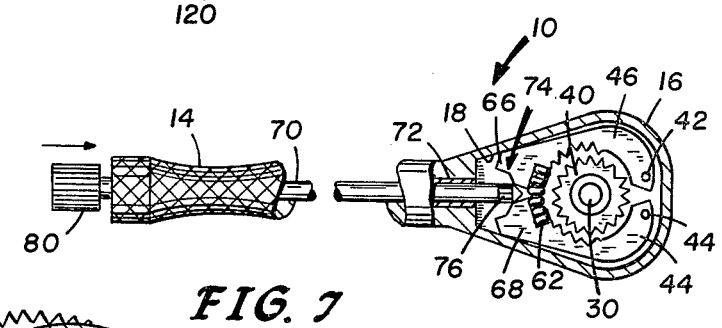
FIG. 7 is a fragmentary partially broken away bottom view of the present invention in a freewheeling mode.

In FIG. 7, the control stem 70 has been pushed toward the drive portion 16 of the housing 12. As a result, the tapered end 74 of the control stem 70 urges both pawls 46 and 48 into disengagement with the ratchet gear 40 permitting the ratchet gear and therefore the mechanically coupled socket mounting block 36 to freely rotate or freewheel. The control stem 70 is maintained in this position by the engagement of protrusion 84 by depression 86 as described in conjunction with FIG. 1. When freewheeling is no longer desired, the user merely pulls back on the knob 80 to urge protrusion 84 out of depression 86 and the wrench 10 will return to the rest position illustrated in FIG. 4 wherein the wrench 10 is locked up.

Reviewing the aforegoing discussion in conjunction with FIGS. 4, 5, 6, and 7, it can readily be seen how, through rotation and reciprocation of the control stem 70, clockwise and counterclockwise ratcheting, lockup, and freewheeling, can all be accomplished.

Figure 8:
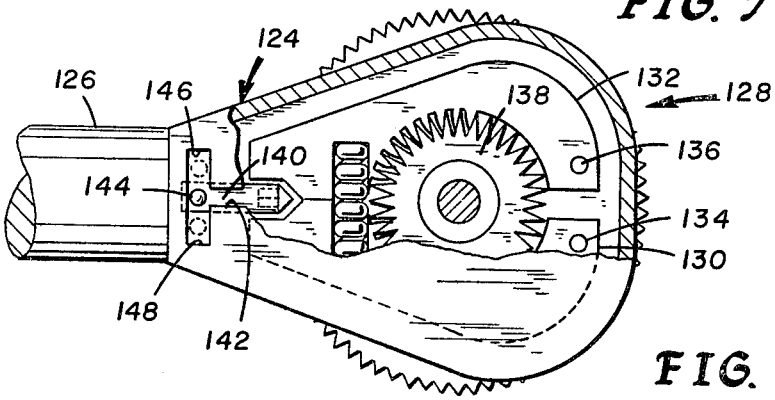
FIG. 8 is an enlarged partially broken away top view of an alternate embodiment of the present invention.

FIG. 8 illustrates an alternate embodiment of the present invention, a socket drive wrench 122. The socket drive wrench 122 includes a housing 124 having a handle portion 126 and a drive portion 128. The wrench 122 includes a pair of pawls 130 and 132 pivotally mounted, respectively, by pivots 134 and 136. The pivots 134 and 136 are disposed about and therefore encircle a ratchet gear 138. The pawls 130 and 132 operate essentially the same as the pawls 46 and 48 of the wrench 10 with the difference in this embodiment being in the control lever 140 provided instead of control stem 70. Control lever 140 rotates and reciprocates in a T-shaped notch 142 and is manipulated by a protrusion 144 readily accessible to the user through the notch 142. When the protrusion 144 is pushed toward the ratchet gear 138, the pawls 130 and 132 are separated and the wrench is put in a freewheeling condition. When the protrusion is pulled away from the pawls 130 and 132 as illustrated in FIG. 8, the wrench 122 is in a lockup condition. When the protrusion is moved into portions 146 and 148 of notch 142, the wrench 122 can ratchet in a clockwise or counterclockwise direction. The control lever 140 can be mounted within the drive portion 128 by disposition in a suitably cut groove as shown, or other expedient well known in the art to provide the necessary mounting. A spring can be provided if desired to urge the control lever 40 into a rest position as illustrated in FIG. 8.

Although the wrench 122 does not provide handle mounted control, it may find application in certain circumstances. It should be understood that although the pawl and ratchet gear assembly of the present invention has been described in conjunction with a socket drive wrench, these principles can be applied to an open ended ratchet wrench or other rotational drive tool or the like or other apparatus within the principles and scope of this invention, such application of the teachings of this invention being within the skill of one of ordinary skill in the art. Additionally, it will be understood that various other changes in the details, materials, arragngements of parts and operational conditions which have been herein described and illustrated in order to explain the nature of the invention may be made by those skilled in the art within the principles and scope of the invention.

Having thus set forth the nature of the invention, what is claimed is:

1. A socket drive wrench for driving sockets comprising:

a housing having a drive portion and a handle portion extending therefrom;

socket mounting means rotatably carried on said drive portion of said housing, said socket mounting means adapted to accept and removably mount thereon said sockets;

ratchet gear means connected to said socket mounting means and rotatable therewith;

a pair of pawls pivotably disposed on said drive portion of said housing about and for selectively engaging said ratchet gear means, said pawls being positionable to permit clockwise and counterclockwise ratcheting, freewheeling, and lockup of said ratchet gear means, each of said pawls having two ends, adjacent ends of said pawls being pivotably mounted to said housing, the other ends of said pawls being movable toward and away from each other, the teeth of each of said pawls engaging said ratchet gear means when said other ends of said pawls are moved toward each other, said teeth of each of said pawls disengaging said ratchet gear means when said other ends of said pawls are moved away from each other;

spring biasing means for urging said other ends of said pair of pawls toward each other to engage said ratchet gear means therebetween; and pawl control means for positioning said pawls, said pawl control means for selectively contacting and positioning one of said pawls to permit clockwise rotation of said ratchet gear means and the other of said pawls to permit counterclockwise rotation, said pawl control means selectively engaging and positioning both of said pawls to permit freewheeling of said ratchet gear means, said pawl control means selectively engaging and positioning both of said pawls to engage said ratchet gear means to effect the lockup thereof, said pawl control means comprising a control arm having first, second, third, and fourth positions, said control arm in said first position contacting one of said pawls and positioning the same so as to be disengaged from said ratchet gear means, said control arm in said second position contacting the other of said pawls and positioning the same so as to be disengaged from said ratchet gear means, said control arm in said third position engaging both of said pawls and positioning them so as to be disengaged from said ratchet gear means, said control arm in said fourth position permitting both of said pawls to engage said ratchet gear means.

2. A socket drive wrench in accordance with claim 1, wherein said drive portion of said housing forms a chamber therein, said socket mounting means having a portion thereof extending into said chamber, said ratchet gear means and said pair of pawls being disposed within said chamber.

3. A socket drive wrench in accordance with claim 1, wherein said spring biasing means comprising a helical tension spring having one end thereof fixedly secured to one of said pawls, the other end thereof being fixedly secured to the other of said pawls.

4. A socket drive wrench in accordance with claim 1, wherein said pair of pawls are complementary and include an arcuate multitoothed ratchet portion, said pawls being disposed about said ratchet gear means so as to substantially encircle the same.

5. A socket drive wrench in accordance with claim 1, further comprising means for locking said control arm in said first, second, third, and fourth positions.

6. A socket drive wrench in accordance with claim 1, wherein said control arm is disposed on said drive portion of said housing.

7. A socket drive wrench in accordance with claim 1, wherein said control arm comprises a stem coaxially mounted in said handle portion to permit free rotation and reciprocation therein, one end of said stem adjacent to the free end of said handle including a knob, the other end of said stem providing a pawl engaging portion.

8. A socket drive wrench in accordance with claim 7, wherein said pawl engaging portion comprises a radially disposed fin mounted on said stem, rotation of said stem in one direction causing said fin to engage and move one of said pawls, rotation of said stem in the other direction causing said fin to engage and move the other of said pawls, pushing of said stem in a direction causing the movement thereof toward said pawls causing the portion of said stem adjacent to said fin to engage both said pawls and to move them into a position disengaging said ratchet gear means, pulling of said stem in a direction causing the movement thereof away from said pawls causing said pawls to both engage said ratchet gear means.

9. A socket drive wrench in accordance with claim 8, further comprising spring biasing means for effecting said pulling of said stem.

10. A socket drive wrench in accordance with claim 8, wherein said locking means for locking said control arm in said first and second positions comprises depressions in said pawls adjacent to the points of contact between said fin, said depression for capturing and releasably retaining therein said fin.

11. A socket drive wrench in accordance with claim 1, further comprising means for facilitating the removal of a socket from said socket mounting means.

12. A socket drive wrench in accordance with claim 1, further comprising a plate having a serrated edge fixedly secured to said socket mounting means to facilitate the rotation thereof.

13. A socket drive wrench in accordance with claim 1, wherein each of said pawls have two ends, adjacent ends of said pawls being pivotably mounted to said housing at a position at one side of an imaginary line substantially orthogonal to the rotational axis of said ratchet gear means, the other ends of said pawls being movable toward and away from each other and being disposed on the other side of said imaginary line, the teeth of each of said pawls engaging said ratchet gear means when said other ends of said pawls are moved toward each other, said teeth of each of said pawls disengaging said ratchet gear means when said other ends of said pawls are moved away from each other.

14. A socket drive wrench in accordance with claim 13, wherein said pair of pawls are complementary and include an arcuate multitoothed ratchet portion, said pawls being disposed about said ratchet gear means so as to substantially encircle the same.

15. A pawl and ratchet assembly comprising:

ratchet gear means;

a pair of elongated complementary pawls substantially encircling therebetween said ratchet gear means, each of said pawls being pivotably mounted on adjacent ends thereof, the other ends of said pawls being engagable to position said pawls for engagement with or disengagement from said ratchet gear means, engagement of said ratchet gear means by one of said pawls permitting clockwise rotation of said ratchet gear means, engagement of said ratchet gear means by the other of said pawls permitting counterclockwise rotation of said ratchet gear means, engagement of said ratchet gear means by both of said pawls permitting lockup of said ratchet gear means, and disengagement of both of said pawls from said ratchet gear means permitting freewheeling of said ratchet gear means; and pawl control means for positioning said pawls, said pawl control means contacting and positioning one of said pawls to permit said clockwise rotation of said ratchet gear means and the other of said pawls to permit said counterclockwise rotation, said pawl control means engaging and positioning both of said pawls to permit said freewheeling of said ratchet gear means said pawl control means permitting the positioning of both of said pawls to effect the lockup of said ratchet gear means, said pawl control means comprising a control arm having first, second, third, and fourth positions, said control arm in said first position contacting one of said pawls and positioning the same so as to be disengaged from said ratchet gear means, said control arm in said second position contacting the other of said pawls and positioning the same so as to be disengaged from said ratchet gear means, said control arm in said third position engaging both of said pawls and positioning them so as to be disengaged from said ratchet gear means, said control arm in said fourth position permitting both of said pawls to engage said ratchet gear means.

16. A pawl and ratchet assembly in accordance with claim 15, wherein each of said pawls includes an arcuate multitoothed ratchet portion for engaging said ratchet gear means.

17. A pawl and ratchet assembly in accordance with claim 15, further comprising spring biasing means for urging said other ends of said pair of pawls toward each other to engage said ratchet gear means therebetween.

18. A pawl and ratchet assembly in accordance with claim 17, wherein said spring biasing means comprises a helical tension spring having one end thereof fixedly secured to one of said pawls, the other end thereof being fixedly secured to the other of said pawls.

19. A pawl and ratchet assembly in accordance with claim 15, further comprising means for locking said control arm in said first, second, third, and fourth positions.

20. A pawl and ratchet assembly in accordance with claim 15, wherein said control arm comprises a stem mounted to permit rotation around the longitudinal axis thereof and reciprocation therealong.

21. A pawl and ratchet assembly in accordance with claim 20, wherein said pawl engaging portion comprises a radially disposed fin mounted on said stem, rotation of said stem in one direction causing said fin to engage and move one of said pawls, rotation of said stem in the other direction causing said fin to engage and move the other of said pawls, pushing of said stem in a direction causing the movement thereof toward said pawls causing the portion of said stem adjacent to said fin to engage both said pawls and to move them into a position disengaging said ratchet gear means, pulling of said stem in a direction causing the movement thereof away from said pawls causing said pawls to both engage said ratchet gear means.

22. A pawl and ratchet assembly in accordance with claim 21, wherein said locking means for locking said control arm in said first and second positions comprises depressions in said pawls adjacent to the points of contact between said fin, said depression for capturing and releasably retaining therein said fin.

23. A pawl and ratchet assembly in accordance with claim 15, wherein each of said pawls have two ends, adjacent ends of said pawls being pivotably mounted at a position at one side of an imaginary line substantially orthogonal to the rotational axis of said ratchet gear means, the other ends of said pawls being movable toward and away from each other to position said pawls for engagement with or disengagement from said ratchet gear means, said other ends of said pawls being disposed on the other side of said imaginary line, engagment of said ratchet gear means by one of said pawls permitting clockwise rotation of said ratchet gear means, engagement of said ratchet gear means by the other of said pawls permitting counterclockwise rotation of said ratchet gear means.

24. A pawl and ratchet assembly in accordance with claim 23, wherein each of said pawls includes an arcuate multitoothed ratchet portion for engaging said ratchet gear means.

25. A pawl and ratchet assembly in accordance with claim 23, further comprising pawl control means for positioning said pawls, said pawl control means contacting and positioning one of said pawls to permit said clockwise rotation of said ratchet gear means and the other of said pawls to permit said counterclockwise rotation, said pawl control means engaging and positioning both of said pawls to permit freewheeling of said ratchet gear means, said pawl control means permitting the positioning of both of said pawls to effect the lockup of said ratchet gear means.

* * * * *